United States Patent [19]

Read

[11] 4,213,425

[45] Jul. 22, 1980

[54] INTERNAL COMBUSTION ENGINE FUEL INJECTION CONTROL

[75] Inventor: Martin A. Read, Redditch, England

[73] Assignee: Lucas Industries Limited, Birmingham, England

[21] Appl. No.: 831,311

[22] Filed: Sep. 7, 1977

[30] Foreign Application Priority Data

Sep. 21, 1976 [GB] United Kingdom ..... 39026/76

[51] Int. Cl.[2] ..... F02M 51/00; F02B 3/00

[52] U.S. Cl. ..... 123/478

[58] Field of Search ..... 123/32 EA, 139 AP, 32 AE, 123/119 EC

[56] References Cited

U.S. PATENT DOCUMENTS

| | | | |
|---|---|---|---|
| 3,587,536 | 6/1971 | Inoue et al. | 123/32 EA |
| 3,612,009 | 10/1971 | Kamazuka et al. | 123/32 EA |
| 3,699,932 | 10/1972 | Aono et al. | 123/32 EA |
| 3,702,601 | 11/1972 | Gordon et al. | 123/32 EA |
| 3,834,362 | 9/1974 | Takeshita et al. | 123/32 EA |
| 3,854,458 | 12/1974 | Reddy | 123/32 EA |
| 3,855,973 | 12/1974 | Scofield | 123/32 EA |
| 4,051,816 | 10/1977 | Masaki | 123/32 EA |
| 4,058,709 | 11/1977 | Long | 123/32 EA |

*Primary Examiner*—P. S. Lall

*Attorney, Agent, or Firm*—Ladas & Parry

[57] ABSTRACT

An internal combustion engine fuel injection control has two groups of injectors energized alternately by a pulse duration modulating control system, in accordance with a fuel demand signal. There is also a circuit controlled by $V_{fd}$ for changing the phase of the injection sequence when $V_{fd}$ is below a predetermined value to vary the timing of injection relative to the timing of engine valve actuation.

5 Claims, 3 Drawing Figures

INTERNAL COMBUSTION ENGINE FUEL INJECTION CONTROL

This invention relates to an internal combustion engine fuel injection control and has as its object to provide such a control in accordance with the invention.

In its broadest aspect, the invention resides in a control comprising means for generating an electrical fuel demand signal varying in accordance with at least one engine parameter at least one injector for injecting fuel into the engine, the quantity of fuel injected at each operation of the injector being determined by said fuel demand signal and means synchronising the injector operation with the engine operating cycle and including phase varying means sensitive to the fuel demand signal for varying the timing of commencement of injection in accordance with the fuel demand signal.

Conventionally, in a multi-cylinder engine control, the injectors are arranged to operate in two groups, the injectors of each group operating simultaneously with one another and the injectors of the two groups operating alternately. In a four-stroke cycle, one group of injectors operates during one revolution of the engine crankshaft and the other group operates in the next revolution.

The invention may be applied to such a conventional system by changing the phase of operation of the injectors by 360° relative to the engine shaft, according to whether the fuel demand is above or below a predetermined level.

Preferably, the control includes a circuit for compensating for injection operations "lost" or "gained" during a change of phase as will be hereinafter explained in detail.

In the accompanying drawings

Figure 1:
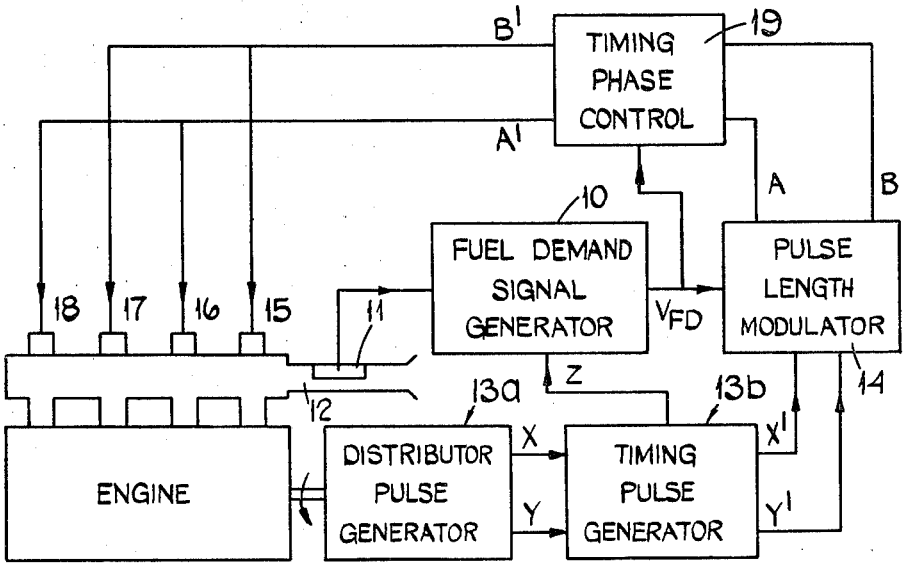
Figure 2:
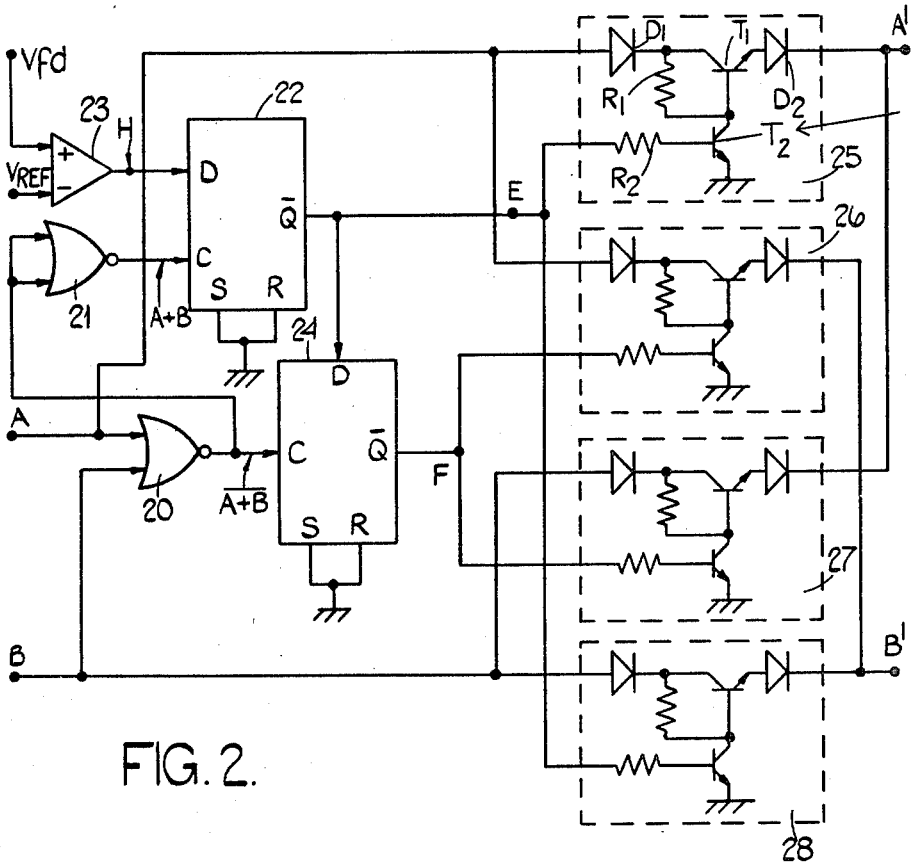
Figure 3:
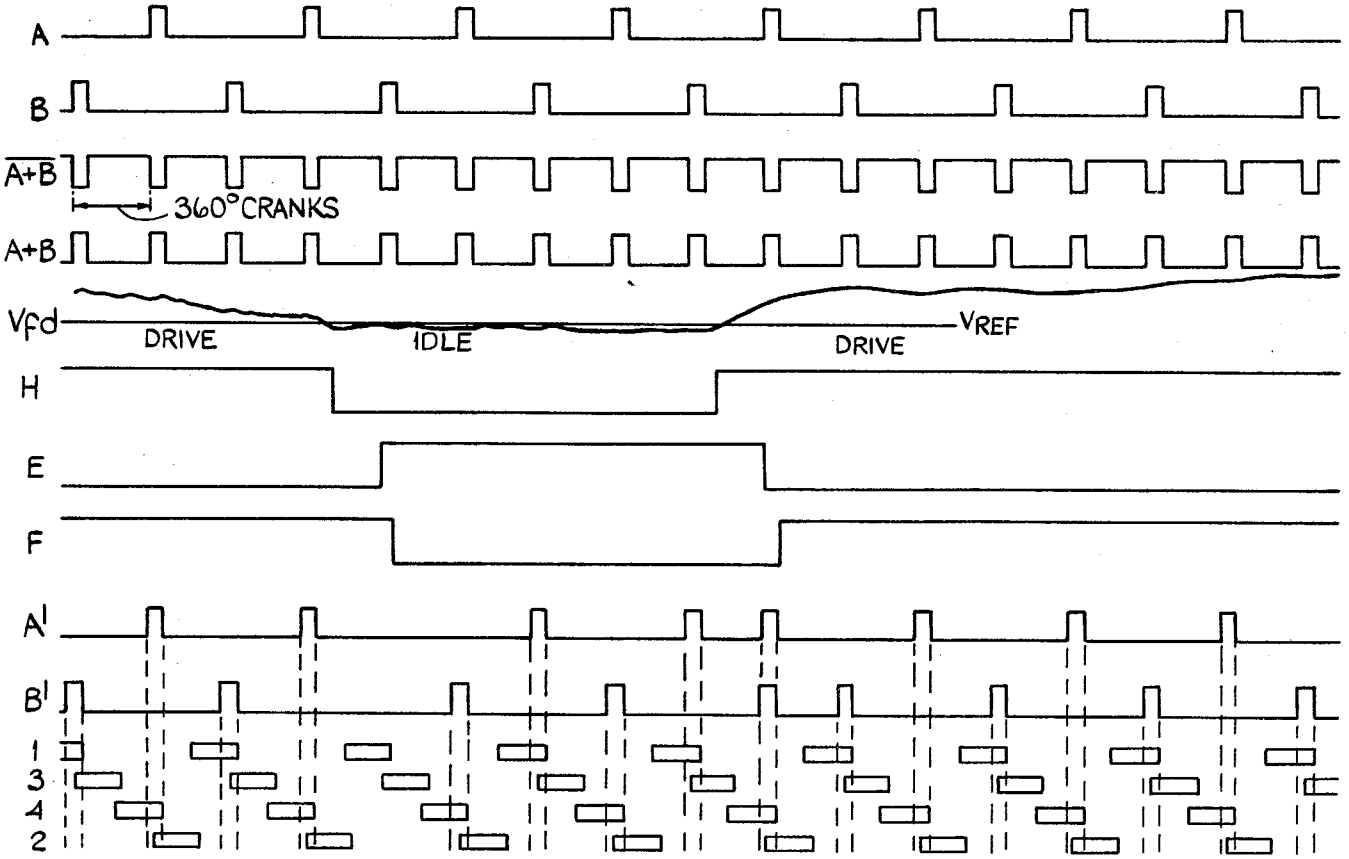

FIG. 1 is a diagrammatic representation of an example of a fuel injection control in accordance with the invention, FIG. 2 is a circuit diagram of a timing phase control forming part of the control of FIG. 1 and FIG. 3 is a series of graphs showing wave forms at different positions in the circuit of FIG. 2 as well as engine value opening timings.

Referring firstly to FIG. 1, the control includes a fuel demand signal generator (10) which is sensitive to one or more engine parameters and produces an output signal $V_{fd}$ proportional to the required quantity of fuel per engine cycle. The signal generator 10 may be controlled by an air flow transducer 11 in the engine air intake manifold 12. There is also a distributor pulse generator 13*a*, driven by the engine and providing two pulse trains X and Y in synchronism with engine operation and antiphase with one another. A timing pulse generator 13*b* generates from both X and Y, pulses Z. The fuel demand signal generator 10 receives these pulse trains as further inputs so that it can operate to provide an output signal dependent on both air flow and engine speed as required. The timing pulse generator 13*b* further produces pulses X′ and Y′ associated respectively with X and Y.

These pulses together with the fuel demand signal $V_{fd}$ are used to control a pulse length modulator 14. This arrangement is a well known one in which when the modulator 14 receives a pulse at one input terminal X′ it generates a pulse on output A for a length of time proportional to the signal $V_{fd}$ and when it receives a pulse at another input terminal Y′ it generates a pulse on output B of similar length.

The pulses A and B are fed to the timing phase control 19 together with the fuel demand signal $V_{fd}$. The timing phase control 19 generates output pulses A′ and B′ whose length is identical with A and B and whose phase relative to A and B is set according to the fuel demand signal $V_{fd}$. The pulses A′ and B′ are fed via power amplifiers (not shown here) to fuel injection valves 15, 16, 17 and 18. One output is fed to injection valves 15 and 17 and the other to valves 16 and 18. The injectors 15 to 18 are associated with respective cylinders of the engine, being arranged to spray fuel into the branches of the manifold towards the intake valve of each cylinder.

The timing phase control 19 (FIG. 2) comprises a NOR gate 20 with inputs A and B from the modulator 14. The relationship of the pulses on these inputs A and B to the valve opening times is seen in FIG. 3 where the top two trains show the A and B pulses and the bottom four lines show valve opening times. The A pulses occur at a time when the intake valves of cylinders 1 and 3 (with which the injectors 15 and 17 are associated) are closed, but overlap the times when the valves of the other two cylinders are open. Similarly the B pulses overlap the open times of the valves of cylinders 1 and 3 but occur when the valves of cylinders 2 and 4 are closed.

The gate 20 produces an output $\overline{A+B}$, ie an output which is normally high but goes low for the duration of each A or B pulse. The output terminal of the gate 20 is connected to a NOR gate 21 which is connected as a logical inverter to produce a signal A+B, i.e. an output which is normally low but goes high for the duration of each A or B pulse. The gates 20 and 21 may be constituted by two of the gates of a Motorola MC 14001 CMOS integrated circuit.

The output terminal of the gate 21 is connected to the CLOCK terminal of a D. Type positive going edge clocked flip flop circuit 22 which may be one half of a Motorola MC 14013 CMOS integrated circuit. The SET and RESET terminals of the flip flop circuit 22 are both grounded and the DATA input terminal is connected to the output terminal H of a voltage comparator 23 which compares the fuel demand signal $V_{fd}$ with a reference voltage $V_{REF}$ and produces a high output only when $V_{fd}$ is greater than $V_{REF}$. The $\overline{Q}$ output terminal of the flip flop 22 is connected to an output terminal E.

A second D. type positive going edge clocked flip flop circuit 24 (which may be the other half of the MC 14013 integrated circuit) has its DATA input terminal connected to the $\overline{Q}$ output terminal of the circuit 22 and its CLOCK terminal connected to the output terminal of the gate 20. The SET and RESET input terminals of circuit 24 are both grounded and its $\overline{Q}$ output terminal is connected to an output terminal F.

The terminals A and B are connected via a group of four transistor switching circuit 25, 26, 27 and 28 to the terminals A′ and B′. Each switching circuit 25 to 28 comprises an input terminal and a control terminal, with the input terminal connected by diode $D_1$ to the collector of a transistor $T_1$ with its emitter connected by a second diode $D_2$ to an output terminal. A resistor $R_1$ connects the base of the transistor $T_1$ to its collector and there is a second transistor $T_2$ with its collector connected to the base of the transistor $T_1$ its emitter grounded and its base connected by a resistor $R_2$ to the control terminal. The input terminals of circuits 25 and 26 are connected to the A terminal, and the input terminals of circuits 27 and 28 are connected to the B terminal. The control terminals of the circuits 25 and 28 are connected to the E terminal and those of circuits 26 and 27 to the F. terminal, and the output terminals of circuits 25 and 27 are connected to the terminal A', those of the circuits 26 and 28 being connected to the terminal B'.

The overall effect of the circuit of FIG. 2 is illustrated in FIG. 3 from which it will be noted that the A' pulses are between the valve openings for cylinders 1 and 3 whenever $V_{fd}$ is greater than $V_{REF}$ but overlap with these valve openings whenever $V_{fd}$ is less than $V_{REF}$. Similar results apply to the B' pulses and the valves of cylinders 2 and 4. Stated differently, the A' pulses coincide with the A pulses when $V_{fd}$ is greater than $V_{REF}$, but with the B pulses when $V_{fd}$ is less than $V_{REF}$, and the B' pulses coincide with the B or A pulses accordingly.

It will be noted that the arrangement described also ensures that there is no drastic overfuelling or underfuelling when a 360° change in phase takes place ie. when $V_{REF}=V_{fd}$. In the example shown in FIG. 3, $V_{fd}$ falls below $V_{REF}$ shortly after an A pulse, so that at that instant the H signal goes low. If the E and F signals went high and low respectively at the same instant, the immediately following B pulse would cause an A' pulse which would result in the total amount of fuel injected into cylinders 1 and 3 being excessive. However the E signal goes high at the start of this B pulse and the F signal goes low at the end of it thereby ensuring that that particular B pulse is not included in either the A' or the B' pulse trains.

At the opposite transition when $V_{fd}$ rises through $V_{REF}$ shortly after a B pulse an extra pulse is included in each A' and B' pulse train since the fuel demand is rising and the long delay which might otherwise occur could cause a hesitation in acceleration. If the phase change alone took place at the instant when $V_{fd}$ exceeded $V_{REF}$, the immediately following A pulse would not create a B' and there would thus be 720° of crankshaft rotation between adjacent B' pulses resulting in no fuel being fed in one stroke to cylinders 2 and 4. However, since E goes low at the start of this next B pulse and F does not go high until the end of the B pulse, the B pulse causes A' and B' pulses simultaneously.

The level of $V_{REF}$ may be set to indicate engine-idling.

In the above described example the generator 10 produces an analogue signal and the comparator 23 is a voltage comparator. It is equally possible, however, to employ a fully digital system in which the output of the generator 10 is a multi-bit digital signal. In this case the comparator 23 would be a multi-bit digital reference signal.

I claim:

1. An internal combustion engine fuel injection control comprising means for generating an electrical fuel demand signal varying in accordance with at least one engine parameter, at least one injector for injecting fuel into the engine, means for generating electrical pulses for operating said injector, pulse length modulation means for modulating the duration of said pulses and having a modulating input connected to receive said fuel demand signal, whereby the quantity of fuel injected at each operation of the injector is determined by said fuel demand signal, and means synchronising the injector operation with the engine operating cycle and including phase varying means sensitive to the fuel demand signal for varying the timing of commencement of injection in accordance with the fuel demand signal.

2. An internal combustion engine fuel injection control as claimed in claim 1 in which said phase varying means includes a comparator connected to said electrical fuel demand signal generating means so as to compare such fuel demand signal with a predetermined level and a logic circuit to which the output of said comparator is connected serving to route activating pulses to the injector.

3. An internal combustion engine fuel injection control as claimed in claim 2 including two groups of injectors, the injectors of each group operating simultaneously and the injectors of the two groups operating alternately, one group operating in a set of alternate engine crankshaft revolutions and the other group operating in the other set of alternate engine crankshaft revolutions, said logic circuit acting to vary the phase of operation of the injectors in discrete steps of 360° relative to the engine shaft.

4. An internal combustion engine fuel injection control as claimed in claim 3 in which said logic circuit includes a NOR gate with two inputs respectively connected to a pair of pulse sources from which pulses of duration determined by the fuel demand signal appear alternately, an inverting circuit connected to the output of the NOR gate, a first positive-going edge clocked flip flop circuit having a clock input connected to the output of the inverting circuit and a D-input, determining the state to which the flip flop circuit is clocked by the next pulse at its clock input, connected to said comparator, a second positive-going edge clocked flip flop circuit having a clock input connected to the output of the NOR gate, and a D-input connected to the output of the first flip flop circuit, so that when the comparator output changes, the first flip flop circuit is triggered by the rising edge of the next pulse from either source and the second flip flop is triggered by the falling edge of the same pulse, and route selection circuit means connecting said sources to injectors and controlled by said flip flops.

5. An internal combustion engine fuel injection system as claimed in claim 4 in which the route selection circuit means comprises four identical circuits each having one input from a selected one of the source and another input from a selected one of the flip flop circuits and each having an output terminal connected to drive a selected one of the injectors, each such circuit including a first transistor arranged with its collector emitter path connecting the selected source to the selected injector drive, a resistor connected to bias the first transistor on when said source produces a pulse and a second transistor for diverting bias current away from said first transistor and having its base connected to the selected one of the flip flop outputs.

* * * * *